US005549154A

United States Patent [19]

Niskanen et al.

[11] Patent Number: 5,549,154

[45] Date of Patent: Aug. 27, 1996

[54] METHOD FOR HEATING A ROLL AND A HEATABLE ROLL

[75] Inventors: Juhani Niskanen, Oulunsalo; Jari Vähäpesola, Muurame, both of Finland

[73] Assignee: Valmet Corporation, Helsinki, Finland

[21] Appl. No.: 417,736

[22] Filed: Apr. 6, 1995

Related U.S. Application Data

[62] Division of Ser. No. 22,073, Feb. 24, 1993, Pat. No. 5,404, 936.

[30] Foreign Application Priority Data

Feb. 24, 1992 [FI] Finland ..... 920805

[51] Int. Cl.[6] ..... F28F 5/02; F28F 13/06

[52] U.S. Cl. ..... 165/89; 165/146; 492/46

[58] Field of Search ..... 165/89, 90, 146, 165/147, 133; 492/46

[56] References Cited

U.S. PATENT DOCUMENTS

| | | | |
|---|---|---|---|
| 1,837,562 | 12/1931 | Mayer | 165/89 |
| 2,420,373 | 5/1947 | Hogberg | 165/135 X |
| 2,661,546 | 12/1953 | Petry et al. | 165/89 |
| 2,875,985 | 3/1959 | Hold | 165/89 |
| 4,074,750 | 2/1978 | Beghin . | |
| 4,077,466 | 3/1978 | Fleissner . | |
| 4,183,298 | 1/1980 | Cappel et al. | 165/90 X |
| 4,405,440 | 9/1983 | Gwyn . | |
| 4,470,709 | 9/1984 | Koehler et al. . | |
| 4,498,383 | 2/1985 | Pav et al. . | |
| 4,658,486 | 4/1987 | Schonemann . | |
| 4,700,771 | 10/1987 | Bennett et al. | 165/133 |
| 4,794,984 | 1/1989 | Lin . | |
| 4,875,297 | 10/1989 | Zaoralek . | |
| 4,913,224 | 4/1990 | Moran . | |

FOREIGN PATENT DOCUMENTS

| | | | |
|---|---|---|---|
| 69667 | 2/1983 | Finland . | |
| 74069 | 4/1987 | Finland . | |
| 882865 | 12/1988 | Finland . | |
| 2431069 | 1/1976 | Germany | 165/89 |
| 102268 | 6/1984 | Japan | 165/89 |
| 1458682 | 2/1989 | U.S.S.R. | 165/147 |
| 303191 | 12/1928 | United Kingdom | 165/90 |

*Primary Examiner*—Leonard R. Leo
*Attorney, Agent, or Firm*—Steinberg, Raskin & Davidson P.C.

[57] ABSTRACT

The invention relates to a method for heating a roll and a heatable roll for use in a paper machine, paper finishing machine, or equivalent. The roll is heated by a heating medium which is introduced into the roll interior through at least one of the ends of the roll. The heating medium acts upon the material of the roll mantle or the roll and is arranged to flow across the axial length of the roll. The heating medium is arranged to flow out of the roll through either one of the ends of the roll. The roll is provided with means by which the coefficient of heat transfer from the flowing heating medium to the material of the roll is increased in the flow direction of the heating medium.

7 Claims, 4 Drawing Sheets

METHOD FOR HEATING A ROLL AND A HEATABLE ROLL

This is a division, of U.S. patent application Ser. No. 08/022,073, filed Feb. 24, 1993 now U.S. Pat. No. 5,404, 936.

BACKGROUND OF THE INVENTION

The invention relates to a heatable roll for a paper machine, paper finishing machine, or equivalent. The roll is heated by a heating medium which is introduced into the roll interior through at least one of the ends of the roll. The heating medium acts upon the material of the roll mantle, or the material of the roll, and is arranged to flow across the axial length of the roll. Thereafter, the heating medium is arranged to flow out of the roll through either one of the ends of the roll, i.e. the same end through which the heating medium entered into the roll or an opposite end.

The invention also relates to a method for heating a roll for use in paper machines, paper finishing machines or other paper machines. A heat transfer medium is introduced into a roll, circulated through the roll and removed from the roll. In this manner, the material of the roll mantle or the material of the roll is heated.

Further, the invention also relates to a method for maintaining a substantially constant temperature on an outer surface of the roll over which a paper web or board will pass.

In paper machines and paper finishing machines, in particular in calenders and super-calenders, heatable rolls are commonly used. The rolls are heated by means of a heat-transfer medium, such as hot water or oil.

There are mainly two different types of heatable rolls in the prior art. The first type of heatable rolls have a roll mantle, or are massive rolls, wherein substantially axial bores are formed in proximity to the outer face of the roll. The heating medium is made to flow through the bores from one end of the roll to an opposite end of the roll. Generally, a number of such bores are provided in the roll and are uniformly spaced in the direction of the circumference of the roll. The heating medium may be arranged to circulate in the bores either once in a direction from one end of the roll to the other, or twice, or even several times, so that in adjacent bores the heating medium flows in opposite directions. One such so-called "drilled roll" has been described earlier, e.g., in published European Patent Application No. EP-0 158 220.

On the other hand, a second type of heatable roll is a so-called double-mantle roll or rolls provided with an interior piece. This type of heatable roll is commonly used in paper machines. In this type of roll, an interior piece is fitted inside the roll mantle so that an annular intermediate space remains between the interior piece and an inner face of the roll mantle. The heating medium circulates in the annular space from one end of the roll to the other end of the roll. One such roll provided with an interior piece is described, e.g., in Finnish Patent No. 74,069.

A problem in prior art heatable rolls is that owing to the construction of the rolls, the profiles of the surface temperature in the rolls are almost always uneven. The rising differences in temperature in the axial direction of the roll are influenced by the construction and size of the roll. In rolls provided with interior pieces, typical differences in the surface temperature, on the surface over which the web runs, in the axial direction of the roll are in the range about 3° C. to about 6° C. On the other hand, in drilled rolls, a typical reduction of the surface temperature between the ends of the bores in the roll is in the range of about 3° C. while the maximum difference in temperature in the axial direction of the roll is in the range of about 9° C. and the difference in temperature in a cross-sectional plane of the roll is in the range of about 6° C.

The temperature differences in both types of prior art rolls produce dangerous and very detrimental thermal strains in the roll. Deformations which can be noticed in the smoothness of the paper, and which deteriorate the runnability of the machine, are also caused by such temperature differences. Therefore, a commonly imposed requirement on the variations in temperature in the working face, i.e. the outer face, of a roll is in the range of about ±1.5° C. Thus, in prior art rolls, it is a significant drawback that the rolls have not been able to conform with this requirement.

Reference is also made to U.S. Pat. No. 4,658,486 (Schonemann) which describes a heatable calendar roll having axial passages formed in the roll mantle for circulating a heating medium. However, it is a significant drawback that the roll described in this reference does not provide a substantially uniform temperature along the axial length of the roll mantle. This is because there are no means provided to increase the coefficient of heat transfer in the roll material in the flow direction of the heating medium.

OBJECTS AND SUMMARY OF THE INVENTION

It is an object of the present invention is to provide a heatable roll which is an improvement over prior art heatable rolls.

It is another object of the present invention to provide a new and improved method to heat a roll used in a paper machine.

It is yet another object of the present invention to provide a heatable roll having a face in which the differences in temperature are substantially lower than in prior art devices and substantially constant along the axial length of the roll and which rolls comply with the preferred requirements imposed on rolls by users of the rolls in paper machines.

It is still another object of the present invention to provide a new and improved roll in which the coefficient of heat transfer to the outer face of the roll increases as the heat transfer medium flows through the roll.

In view of achieving these objects, and others, the roll in accordance with the invention is provided with means by which the coefficient of heat transfer from the flowing heating medium that acts upon the material of the roll mantle to the material of the roll is increased in the flow direction of the heating medium.

The present invention provides a number of important advantages in comparison to prior art devices. In the present invention, the surface temperature of the roll mantle can be made substantially uniform and the amount of the heating medium used for the heating of the roll can be reduced substantially. For these reasons, the pumping capacity of the heating medium that is needed to heat the roll is not as high as in prior art devices. Moreover, a uniform temperature of the roll mantle has a highly favorable and significant effect on the quality of the paper. It is a further remarkable advantage that, by means of simple operations and/or modifications, the invention can be applied to existing prior art rolls.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
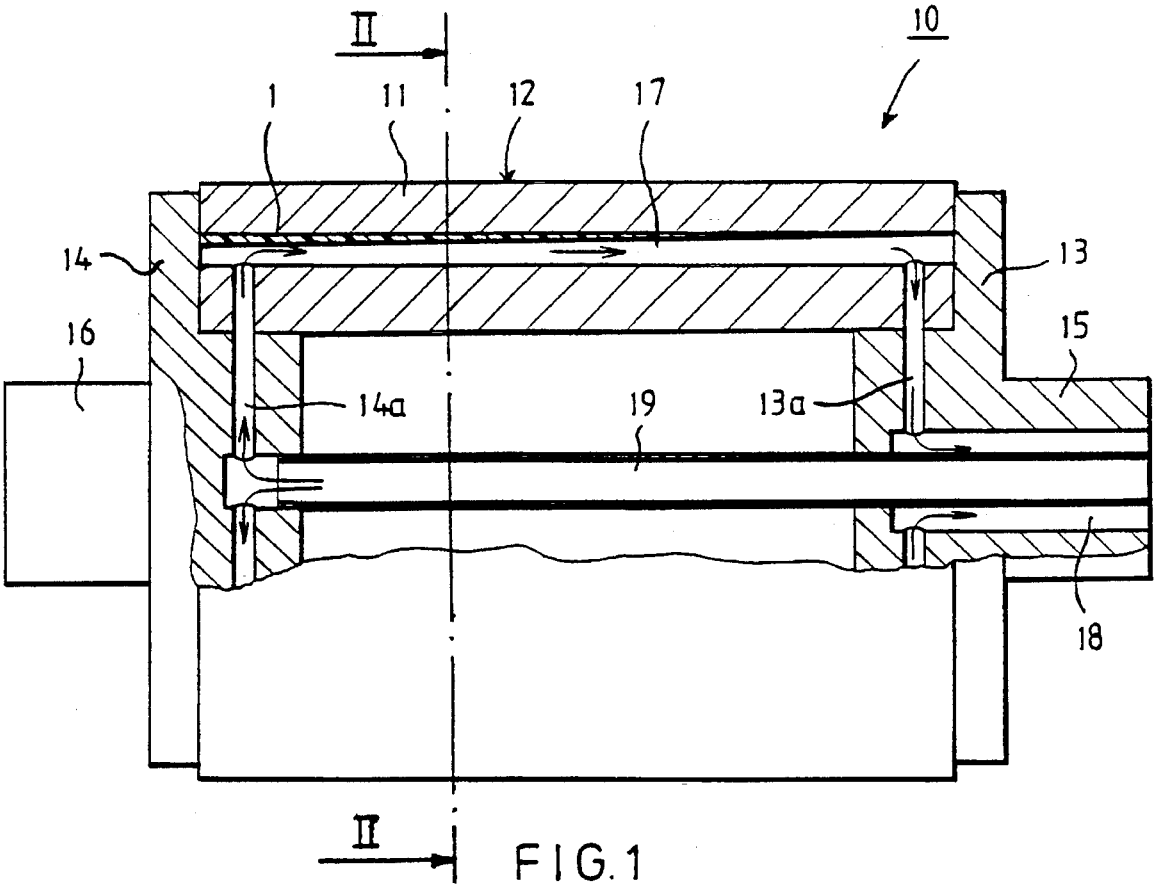
FIG. 1 is a schematic, partly sectional longitudinal view of a drilled roll in accordance with the invention and used in a method in accordance with the invention.

In FIGS. 1, 2, 3 and 5, a heatable roll in accordance with the present invention is denoted generally with the reference numeral 10. The roll 10 comprises a roll mantle 11 having a pair of ends arranged on opposite axial sides of the roll. Roll ends 13,14 are fixed to each of the ends of the roll mantle 11 and are provided with axle journals 15,16, respectively. Bores 17 are arranged in the roll mantle 11 in proximity to an outer face, or surface, 12 of the roll 10. The bores 17 may be drilled into the roll mantle and extend from one end of the roll to an opposite end of the roll. In the embodiments shown in FIGS. 1, 2 and 3, bores 17 are arranged to run substantially in the axial direction of the roll 10.

Figure 2:
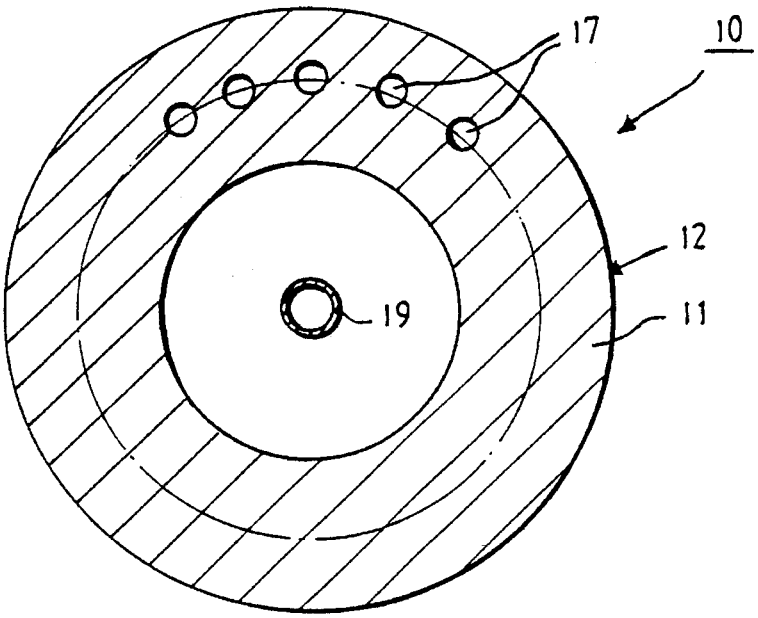
FIG. 2 is a schematic cross-sectional view taken along the line II—II in FIG. 1.

As shown in FIG. 2, several bores 17 are arranged in the circumferential direction of the roll 10 and are distributed substantially evenly over the circumference. An axial central bore 18 is arranged to pass through the first roll end 13 of the roll and into the axle journal 15 provided therein. The axial central bore 18 may be formed, e.g., by drilling, through the material of the roll 10 and roll end 13. A pipe 19 or equivalent is placed through the central bore 18 and extends into the second roll end 14. The diameter of the pipe 19 is smaller than that of the central bore 18, so that an annular gap remains between the pipe and the central bore 18.

A heating medium is introduced into the roll 10 through the pipe 19. The heating medium flows into radial bores 14*a* formed in the second roll end 14 opposite the first roll end 13 so that the heating medium flows across the axial length of the roll 10 from one end to an opposite end of the roll such that the entire surface of the roll is heated. Radial bores 14a extend from the pipe 19 in a center portion of the roll 10 into bores 17 placed in the roll mantle 11. In a corresponding manner, radial bores 13*a* are formed in the first roll end 13 and extend from the bores 17 in the roll mantle into the annular gap in the central bore 18 placed in the first end. Thus, the heating medium flows from the pipe 19 through the radial bores 14a placed in the second roll end 14 into the bores 17 extending from end to end in the roll mantle 11, and from the bores 17 through the radial bores 13a formed in the first roll end 13 into the central bore 18 and further out of the roll 10.

Figure 3:
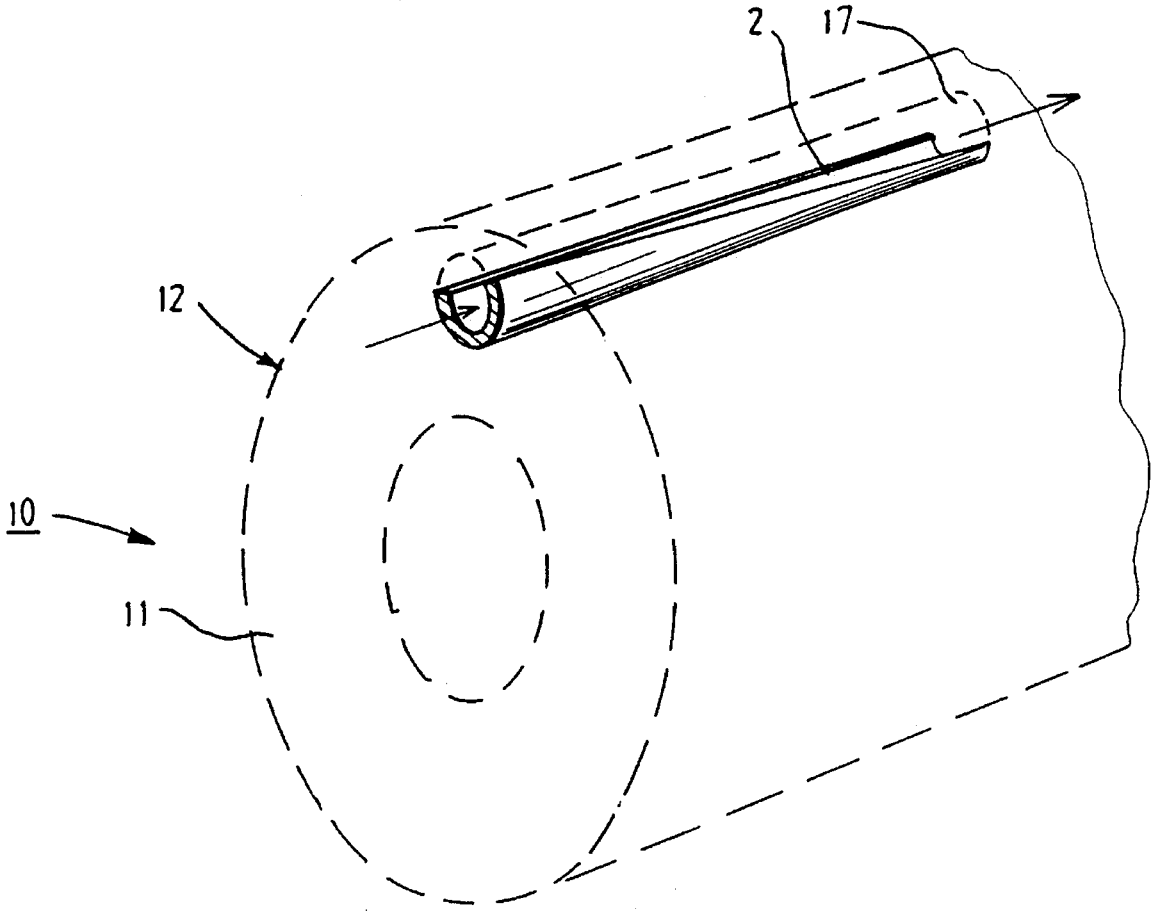
FIG. 3 is a partial perspective view of the roll mantle of a drilled roll as shown in FIG. 1 and of an insulation piece in accordance with the invention arranged in one bore in the roll mantle.

In the embodiments shown in FIGS. 1,2 and 3, the coefficient of heat transfer from the flowing heating medium to the material of the roll mantle 11 is increased in the flow direction of the heating medium by providing suitable means in the roll mantle 11. For example, insulation pieces 1 can be arranged in each of the bores 17 of the roll mantle 11. The insulation pieces 1 might be provided with an outer shell having a decreasing thickness in the flow direction of the heating medium through the bores.

According to FIG. 3, the insulation pieces may consist, e.g., of a tube made of plastic or some other insulation material, into which tube an opening 2 has been formed. The opening 2 is parallel to the longitudinal, i.e. axial, direction of the tube and extends from one end of the tube to an opposite end so that the heating medium can flow therethrough. The size of the opening increases in the flow direction of the heating medium. The opening 2 in the tube is directed towards the outer face 12 of the roll mantle 11. Thus, in the embodiment illustrated in FIG. 3, the proportion of the material of the roll mantle 11 with which the heating medium is in direct contact is increased in the flow direction.

In this embodiment, since the temperature of the heating medium is lowered in the direction of the flow and since, on the other hand, the heating medium can act upon an increasing proportion of the material of the roll mantle 11 in the direction of the flow, the temperature of the roll mantle 11, and thus the outer surface of the roll, is not substantially changed in the axial direction of the roll. The reason the temperature of the heating medium is lowered is because a portion of the heat energy contained within the heating medium is transferred to the roll mantle to heat the roll as the heating medium progresses through the bores 17.

The insulation piece 1 may also be shaped in a manner different from that illustrated in FIGS. 1, 2 and 3. The main point is, however, that the insulation piece 1 should be shaped so that the transfer of heat is restricted in a controlled way in the axial direction of the roll, i.e. in the flow direction. In the manner, the surface temperatures on the roll 10 can be made uniform. At the same time, the conduction of heat can be guided efficiently towards the roll face 12.

In a preferred embodiment, a tubular piece is utilized as the insulation piece 1. In this embodiment, it is possible to accomplish the advantageous heat conduction so that the inner face of the tubular insulation piece 1 becomes conically wider in the flow direction, i.e. the interior diameter increases in the flow direction of the heating medium. In this embodiment, the wall thickness of the tube will become smaller in the flow direction. However, this is more difficult to arrange in practice than the formation of an opening 2 into a tubular insulation 1, which was described above.

Figure 5:
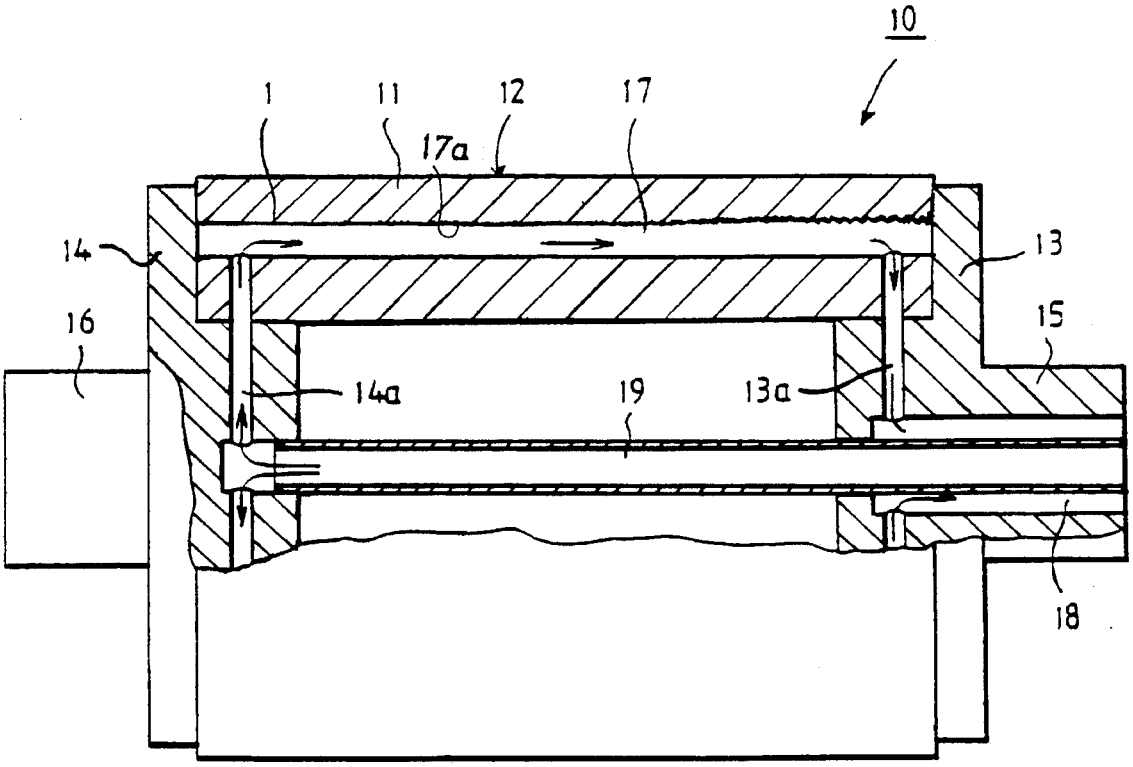
FIG. 5 is a schematic, partly sectional longitudinal view of a drilled roll in accordance with the invention and used in a method in accordance with the invention.

In a drilled roll 10, as shown in FIG. 5 the invention may also be realized, for example, so that the inner surface 17*a* of the bores 17 formed into the roll mantle 11 are roughened. In this embodiment, the degree of roughness of the inner faces of the bores 17 is larger towards the second end of the bores 17, as compared with the first end through which the heating medium begins to flow through the bores 17. In this manner, it is possible to intensify the transfer of heat in the flow direction. This is, however, also more difficult to effect than the embodiment described above.

Figure 4:
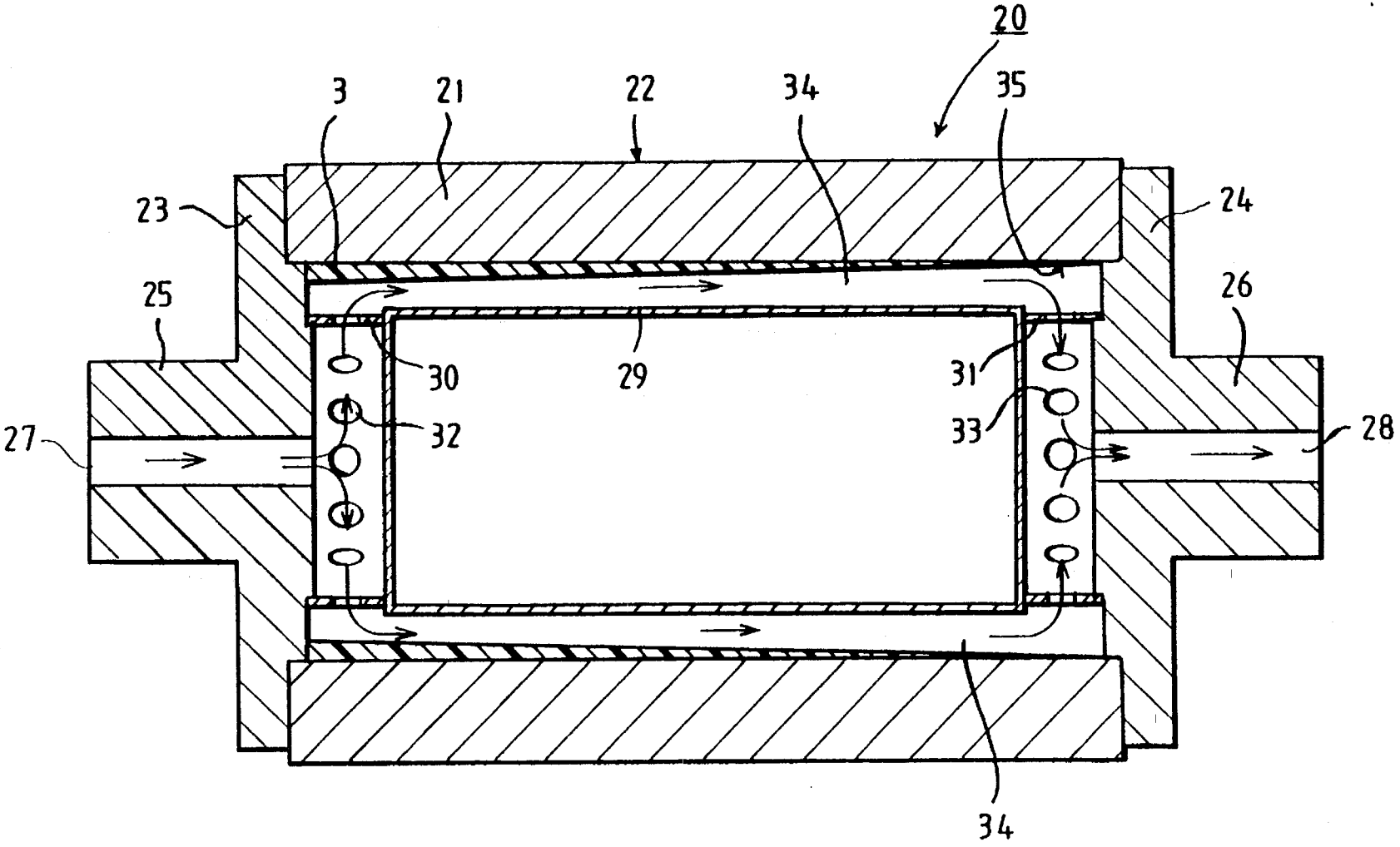
FIG. 4 is a schematic, longitudinal sectional view of a roll provided with a displacement piece in accordance with the invention.

FIG. 4 shows a heatable roll provided with a displacement piece in accordance with the invention, which roll is denoted generally with the reference numeral 20. The roll 20 comprises a roll mantle 21 having a pair of opposite ends to which roll ends 23 and 24 are fixed. Roll ends 23,24 are provided with axle journals 25 and 26, respectively. The roll ends 23,24 are also provided with central through axial bores 27,28. In the interior of the roll mantle 21, a displacement piece 29 has been arranged. The displacement piece 29 is attached to the roll ends 23,24 by means of end pieces 30,31.

The diameter of the displacement piece 29 is smaller than the diameter of the interior of the roll mantle 21 so that an annular intermediate space 34 remains between the displacement piece 29 and the inner face of the roll mantle 35. Several through holes 32,33 have been formed into the circumference of both of the end pieces 30 and 31 of the displacement piece 29. Holes 32 and 33 are opened into the annular intermediate space 4.

The heating medium is introduced into the roll 20 through the axial bore 27 in the first roll end 23, from which it is passed through the holes 32 in the first end piece 30 into the intermediate space 34 between the displacement piece 29 and the roll mantle 21. In the intermediate space 34, the heating medium flows into the other end of the roll, from which it is passed through the holes 33 in the second end piece 31 into the axial bore 28 placed in the second roll end 24, and from there further out of the roll 20.

In the embodiment shown in FIG. 4, the coefficient of heat transfer from the flowing heating medium to the material of the roll mantle 21 is increased in the flow direction. This is accomplished by applying or producing a coating 3 on the inner face 35 of the roll mantle. The coating 3 is produced by any known process, e.g., by spraying, which coating is arranged so that the thickest portion of the coating is at the initial end of the flow, i.e. the end of the space 34 through which the heating medium enters. The thickness of the coating 3 is reduced in the flow direction towards the opposite end of the roll.

The coating 3 is made of a suitable insulation material, such as plastic or equivalent. Thus, at the initial end of the flow, where the temperature of the heating medium is highest, the thickness of the coating 3 that functions as an insulation layer is the largest. Therefore, the transfer of heat from the heating medium to the material of the roll mantle 21 is lowest at this point. In a corresponding manner, the thickness of the coating is reduced towards the other end of the roll, whereby the transfer of heat from the heating medium to the material of the roll mantle 21 becomes easier because the coefficient of heat transfer is higher. By means of this arrangement, the situation is achieved so that the temperature of the outer face 22 of the roll mantle is substantially uniform and invariable over the axial length of the roll.

In the embodiment of FIG. 4, in accordance with the invention, the change in the coefficient of heat transfer from the flowing heating medium to the material of the roll mantle can also be accomplished, e.g., so that the inner face 35 of the roll mantle is roughened so that its inner face is smoothest at the initial end of the flow and roughest at the final end of the flow.

In another embodiment, the insulation material 3 may consist of a net-like solution, or a tubular insulation, having an open area which increases towards the second and final end of the flow. Thus, the surface temperature of the roll mantle will be maintained substantially uniform because the heating medium cools as it progresses along the axial length of the tubular insulation. This is a result of the transfer of heat from the heating medium to the roll mantle through the tubular insulation. However, the coefficient of heat transfer will increase as the heating medium cools so that a substantially constant temperature will be present in the roll mantle.

In a corresponding manner, in the embodiments illustrated in FIGS. 1, 2 and 3, the tubes arranged in the bores in the roll mantle may be perforated, or have porous, net-like openings, i.e. so that the open area of the tubes or net is increased towards the second end of the roll.

The examples provided above are not meant to be exclusive. Many other variations of the present invention would be obvious to those skilled in the art, and are contemplated to be within the scope of the appended claims.

We claim:

1. A heatable roll for a paper machine, paper finishing machine, or equivalent, comprising a roll mantle having a hollow interior, said roll further comprising a first end through which a heating medium is introduced into said interior of said roll mantle such that said roll mantle is heated, said heating medium being arranged to flow across an axial length of said roll mantle, a displacement piece arranged in said interior of said roll mantle such that an annular intermediate space is defined between said roll mantle and said displacement piece, said heating medium being circulated in said intermediate space from said first end of the roll to a second end of the roll opposite said first end, and means to increase the coefficient of heat transfer from the flowing heating medium to said roll mantle in a direction of flow of the heating medium through said roll such that the temperature of said roll mantle is substantially uniform across its axial length, said means comprising a roughened inner face of said roll mantle which defines said intermediate space, said inner face having an increasing degree of roughening in the flow direction of the heating medium.

2. The roll of claim 1, wherein the heating medium flows out of the roll through either said first end or a second end of the roll arranged opposite from said first end in an axial direction of the roll.

3. The roll of claim 1, further comprising end pieces for attaching said displacement piece to said first and second ends of said roll.

4. The roll of claim 3, wherein said first end of said roll includes an axial bore for passing the heating medium into said interior of said roll mantle and said second end of said roll includes an axial bore for passing the heating medium out of said interior of said roll mantle.

5. The roll of claim 4, wherein said axial bores lead to said end pieces, said end pieces comprising holes for enabling fluid communication of the heating medium between said axial bores and said intermediate space.

6. A method for heating a roll of a paper machine, paper finishing machine, or equivalent, comprising introducing a heating medium into a hollow interior of a roll mantle of the roll such that the roll mantle is heated, arranging a displacement piece in the hollow interior of the roll mantle to form an annular intermediate space between an inner face of the roll mantle and the displacement piece in which the heating medium flows, and roughening the inner face of the roll mantle and increasing the degree of the roughening of the inner face in the flow direction of the heating medium to increase the coefficient of heat transfer from the flowing heating medium to the roll mantle in a direction of flow of the heating medium through the roll such that the temperature of the roll mantle is substantially uniform across its axial length.

7. The method of claim 6, further comprising introducing the heating medium into the roll through a first end, flowing the heating medium across an axial length of the roll mantle, and removing the heating medium from the roll through either the end or a second end of the roll arranged opposite from the first end in an axial direction of the roll.

* * * * *